US005188362A

United States Patent [19]

Ashihara

[11] Patent Number: 5,188,362

[45] Date of Patent: Feb. 23, 1993

[54] POLICE BATON WITH CROSSHANDLE AND HANDGUARD

[76] Inventor: Hideyuki Ashihara, 360-1, Samban-cho 8-chome, Matsuyama, Ehime-ken, Japan

[21] Appl. No.: 718,326

[22] Filed: Jun. 17, 1991

[30] Foreign Application Priority Data

Jun. 20, 1990 [JP] Japan ..... 2-161848

[51] Int. Cl.[5] ..... F41B 15/02

[52] U.S. Cl. ..... 273/84 R

[58] Field of Search ..... 273/84 R, 84 A, 5

[56] References Cited

U.S. PATENT DOCUMENTS

| | | | |
|---|---|---|---|
| 1,323,973 | 12/1919 | Frank et al. | 273/84 R X |
| 3,385,601 | 5/1968 | Black | 273/84 R |
| 4,132,409 | 1/1979 | Taylor | 273/84 |
| 4,365,808 | 12/1982 | Perez | 273/84 R |
| 4,455,023 | 6/1984 | Saloom . | |
| 4,703,932 | 11/1987 | Kubota . | |
| 4,752,072 | 6/1988 | Parsons . | |
| 4,949,966 | 8/1990 | Bopp | 273/84 R X |
| 5,041,951 | 8/1991 | Fan | 273/84 R X |

FOREIGN PATENT DOCUMENTS

| | | |
|---|---|---|
| 649578 | 8/1937 | Fed. Rep. of Germany . |
| 61-181996 | 11/1986 | Japan . |
| 2-50091 | 2/1990 | Japan . |
| 2-50092 | 2/1990 | Japan . |

*Primary Examiner*—William H. Grieb

*Attorney, Agent, or Firm*—Nikaido, Marmelstein, Murray & Oram

[57] ABSTRACT

A police baton with crosshandle includes a baton main body and a crosshandle branched in perpendicular from the baton main at a position longitudinally localized from the center to one end of the baton main body, in which a hand guard rotatable relative to the baton main body around the crosshandle as the center of rotation thereof is disposed to the axial center of the crosshandle. The hand of a baton user gripping the crosshandle can always be protected by the hand guard.

12 Claims, 15 Drawing Sheets

POLICE BATON WITH CROSSHANDLE AND HANDGUARD

FIELD OF THE INVENTION

The present invention concerns a police baton with crosshandle. The police baton means herein not only a club or self-defensive billy carried by a policeman or guardsman but also includes similar club-like weapons, for exmaple, a co-called TONFER which is used in the field of military arts such as KARATE.

BACKGROUND OF THE INVENTION

A police baton with crosshandle having a baton main body and a crosshandle secured in perpendicular to the baton main body at a position localized longitudinally from the center to one end of the baton main body has been known. A user of the baton usually grips the crosshandle with his little finger positioned on the side near the baton main body and manipulates the baton while controlling the gripping force. The user performs offense and defense striking an opponent, for example, by rotating the baton around the axis of the crosshandle while thrusting the baton main body, suddenly stopping the rotation or projecting the baton main body along its axial direction. If the user get accustomed to such maneuvers, the police baton with crosshandle can be used in various ways such as quick motion, high speed rotation, sudden start or stop, or jabbing from out of the opponent's view which is difficult to be forecast and, accordingly, it is considered more effective than a simple straight baton.

As the existent police baton with crosshandle of this type, it has been proposed a police baton, for example, in U.S. Pat. No. 4,132,409 in which a portion of the crosshandle, in particular, only the lower portion (base portion relative to the baton main body) is made partially rotatable relative to the baton main body, with an aim of improving the maneuverability.

Generally, it is important for club-like weapon used for hitting with an opponent near at hand, to protect the hand that holds the weapon and protection means are disposed, for example, a guard (TSUBA) for a sword and a hand guard for a saber or the like.

In a case of a relatively short club member such as a police baton, a possibility of injuring the holding hand is further increased. In particular, in a case of the police baton with a crosshandle, since the crosshandle is disposed in perpendicular to the baton main body, different from the haft of the sword or the saber, the knuckle of the hand gripping the crosshandle is fairly exposed directly to the opponent thus tending to be left unguarded. This has a significant meaning worthy of notice.

That is, it is usually considered utterly difficult to make a defensive motion during offensive motion and, accordingly, it is difficult to dodge the opponent's counterattack upon offense. In particular, in a case of striking the opponent by the police baton with crosshandle, the baton main body can be rotated at an extremely high velocity to provide a powerful offensive effect. However, since the hand that grips the crosshandle is situated at the center of the rotation, its motion is relatively slow. In addition, the hand approaches the opponent while being considerably exposed.

This means for the opponent that an easy weakness to attack comes closer.

Further, as the technique of using the police baton with a crosshandle, it may sometimes be manipulated, for example, in such a way as striking the opponent at the end of the baton main body, or sweeping off the weapon swung down by the opponent by rotating the baton main body at a high speed while swinging the hand that grips the crosshandle toward the opponent. In such offense/defense technique, there is a risk that the hand gripping the crosshandle may abut against a target to suffer injuries due to errors in view of a brief timing or aim.

As described above, protection for the hand is particularly important in the police baton with a crosshandle, which is relatively short in length, as a weapon and often brings the knuckle of the hand, being exposed as it is, closer to the opponent in the offense/defense motions. However, no police baton with a crosshandle having a hand guard has yet been proposed.

A primary reason why the police baton is not provided with the hand guard is as follows. Since the police baton with the crosshandle of this type is often used under rotation, different from the saber or the like, no particular consideration has been taken on specifying the directionality of the hand guard (perhaps because of a fixed idea that the hand guard should be attached immovably to the gripping portion). Then, it has been considered that presence of the hand guard hinders the rotational motion of the police baton with the crosshandle making it more workable as the police baton with the crosshandle. In addition, it has also been considered that the hand guard hinders a so-called "quick draw" motion in a state where the police baton is suspended by a holster from the user's waist.

For the saber, if the hand guard is made rotatable relative to the haft, the positional direction changes between the hand guard and the blade making it difficult for gripping the haft, as well as the hand guard displaces along with the swinging motion of the saber or by the opponent's striking, failing to protect the hand. Therefore, the hand guard should be secured to the haft.

OBJECT AND SUMMARY OF THE INVENTION

The present invention has been accomplished taking notice of such problems in the prior art and an object of the invention is to provide a police baton with a crosshandle which can overcome most prominent weakness in the existent police baton with crosshandle that a hand gripping the crosshandle tends to suffer from injuries, and which is easy to manipulate with and more powerful than the usual police baton.

In order to attain the foregoing object, the present inventor has made various trial models and experiments taking notice of the directionality of the hand guard and, as a result, has found that it is most effective for attaining the object that the hand guard is independent of the motion of the baton main body and that the hand guard is directed downward in a state where the police baton is suspended from the user's waist. The present invention has been accomplished based on such a novel finding.

The foregoing object of the present invention can be attained by a police baton with a crosshandle comprising a baton main body and a crosshandle branched perpendicular from the baton main at a position longitudinally localized from the center to one end of the baton main body. A hand guard is relatively rotatable to the baton main body around the crosshandle which is a center of rotation of the handguard. The handguard is disposed traverse to the length of the crosshandle.

In a modified embodiment, the crosshandle comprises a mounting base to be secured to the baton main body, a shank branched from the mounting base perpendicular to the baton main body, a relatively rotational lower member which is slidably fit to the base end of the shank, a relatively rotational upper member which is slidably fit to the top end of the shank, and a static member disposed at an intermediate portion of the shank and secured thereto while being put between the relatively rotational upper and lower members. The hand guard engages at its upper attaching portion to the relatively rotational upper member and engages at its lower attaching portion to the relative rotational lower member respectively.

In this modified embodiment, the hand guard has a generally C-shaped configuration in which the upper attaching portion is in the form of an annular ring or a retainer ring which is fit to the relatively rotational upper member of the crosshandle. The lower attaching portion is in the form of a cylinder or a retainer ring which is fit to the relatively rotational lower member of the crosshandle.

Alternatively, the hand guard may comprise a belt member which is engaged at its base end to a lower attaching portion disposed integrally rotatably to the relatively rotational lower member and engaged at its free end to an upper attaching portion disposed integrally rotatably to the relatively rotational upper member.

In another modified embodiment, the crosshandle comprises a mounting base to be secured to the baton main body, a shank branched from the mounting base in perpendicular to the baton main body, a static member through which the shank is inserted and which is secured to the shank at a position adjacent with the mounting base and a relatively rotational upper member which is slidably fit to the top end of the shank at a position above the static member, in which the hand guard engages at its upper attaching portion to the relatively rotational upper member and is slidably fit rotatably at its relatively rotational lower member to the static member.

In a further modified embodiment of the present invention, the crosshandle comprises a static member having a shank protruded from the upper surface thereof and formed by integral molding with the baton main body and a relatively rotational upper member which is slidably fit to the shank, in which the hand guard engages at its upper attaching portion to the relatively rotational upper member and is rotatably fit slidably at its lower attaching portion to the static member.

In each of the modified embodiments, the hand guard has a generally C-shaped configuration, the upper attaching portion is in the form of an annular ring or a retainer ring which is fit to the relatively rotational upper member of the crosshandle and the lower attaching portion is in the form of an annular ring which is rotatably fit slidably to the static member of the crosshandle.

In each of the modified embodiments, the baton main body comprises a rod member having a solid or hollow portion substantially of an identical diameter extending from the position for the crosshandle to the top end.

Further, in each of the above-mentioned embodiments, the baton main body comprises a rod-like member having a solid or hollow portion which is continuously tapered from the position for the crosshandle to the top end.

Further, in each of the above-mentioned embodiments the baton main body has a telescopic rod-like member comprising a plurality of cylindrical members with diameter different from each other, in which the cylindrical members can be contained successively in a telescopic manner, an inner cylindrical member is popped out of an outer cylindrical member by a centrifugal force applied to the baton main body to extend the axial length, and the rear end of an inner cylindrical member is made engageable with the top end of an outer cylinder immediately adjacent therewith.

In each of the above-mentioned embodiments, the static member of the crosshandle has an elliptic or like other transversal cross sectional shape and the direction of its longer diameter is aligned with the axial direction of the baton main body.

In the each of the above-mentioned modified embodiment, the upper and lower attaching portions of the hand guard are made detachably engageable with the crosshandle.

In the police baton with the crosshandle according to the present invention having thus been constituted, when it is manipulated optionally by rotating the baton main body at high speed, so suddenly stopping it or swinging it straight forward, by gripping the crosshandle, the hand guard attached to the crosshandle freely rotates relative to the baton main body. In other words, the hand guard is always immovable to the gripping hand however the baton main body is rotated. Accordingly, the knuckle of the gripping hand can always be covered and protected with the hand guard to provide a further effective police baton with crosshandle capable of overcoming a most significant weakness in the prior art.

Further, in a case where the baton main body is contained in a holster and suspended from the waist with the crosshandle being positioned horizontal so as to enable "quick-draw", the hand guard is spontaneously directed downward by its own weight. Accordingly, the police baton can be drawn out at any time instantaneously from the holster by gripping the crosshandle without having the hand guard interfere.

DESCRIPTION OF THE ACCOMPANYING DRAWINGS

These and other objects, features, as well as advantageous effects of the present invention will become apparent by reading the following descriptions for the preferred embodiments according to the present invention with reference to the accompanying drawings, wherein FIG. 1 is a perspective outer view of a first embodiment according to the present invention;

Figure 1:
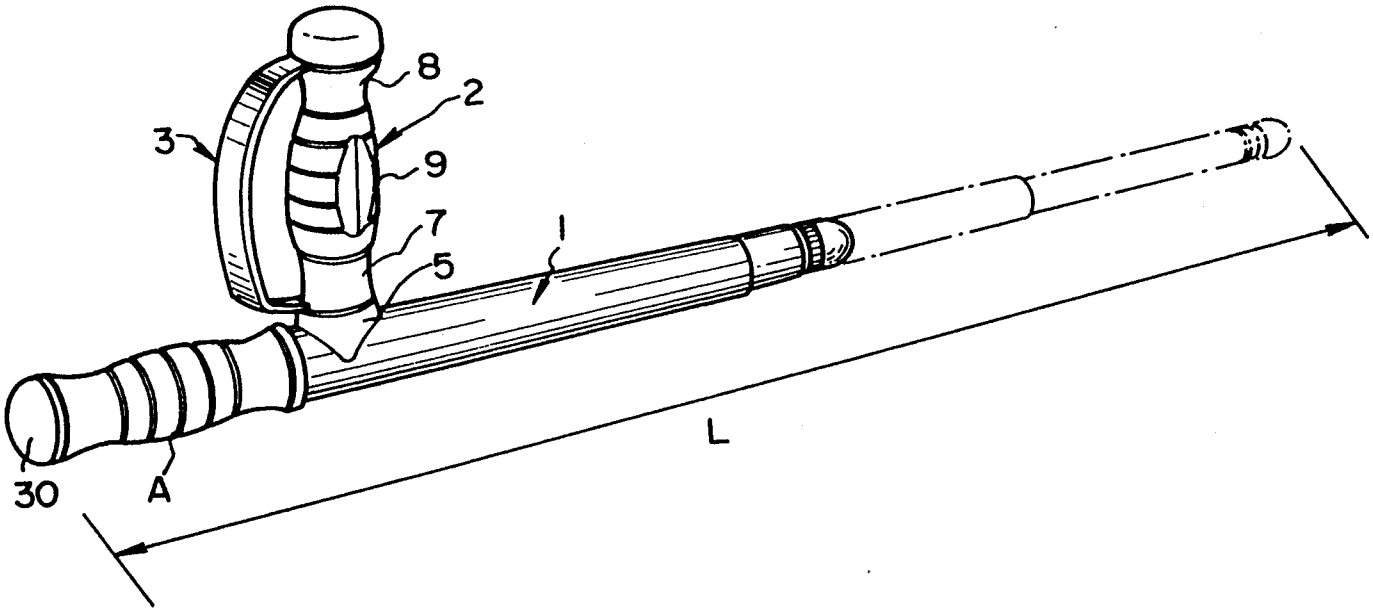
Figure 7A:
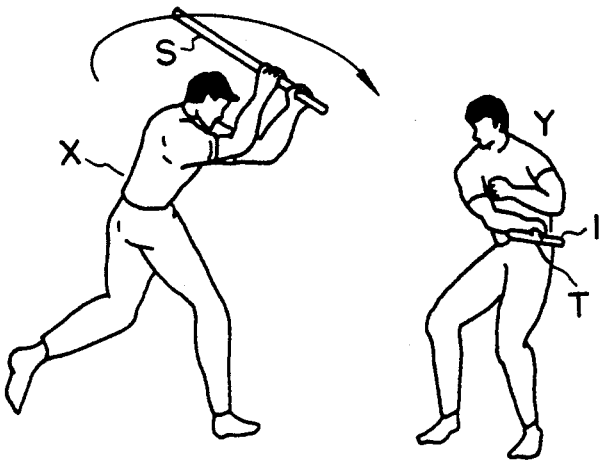
Figure 7B:
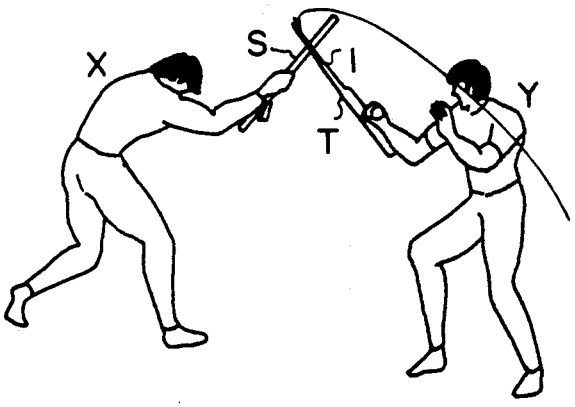
Figure 7C:
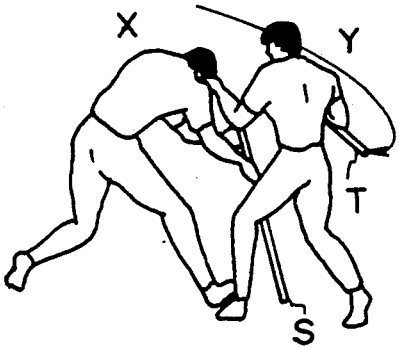
Figure 8:
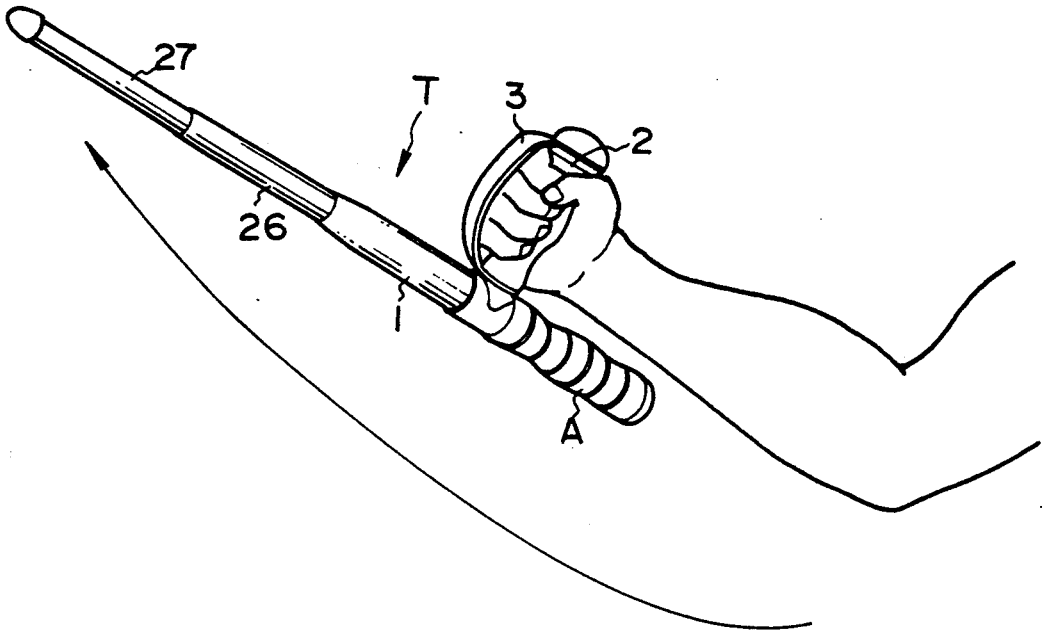
Figure 8:
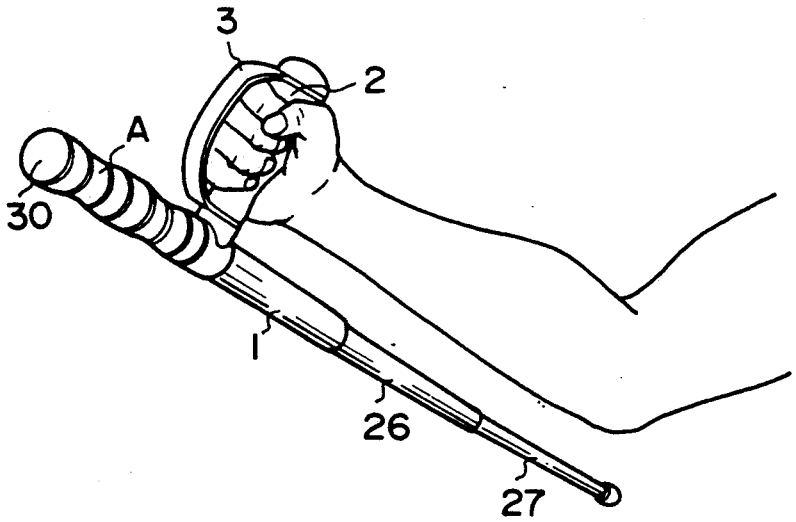
Figure 9A:
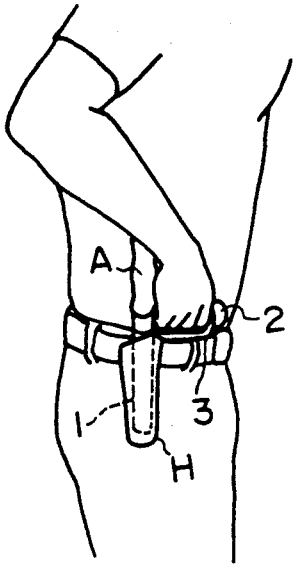
Figure 9B:
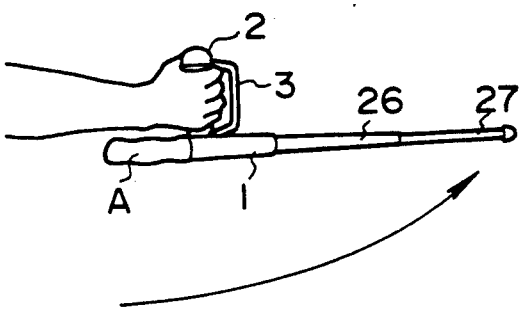
Figure 9C:
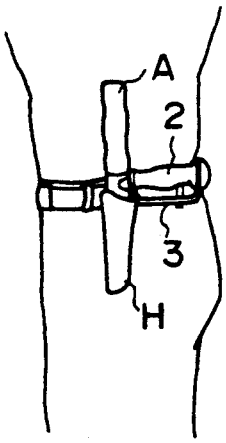
Figure 9D:
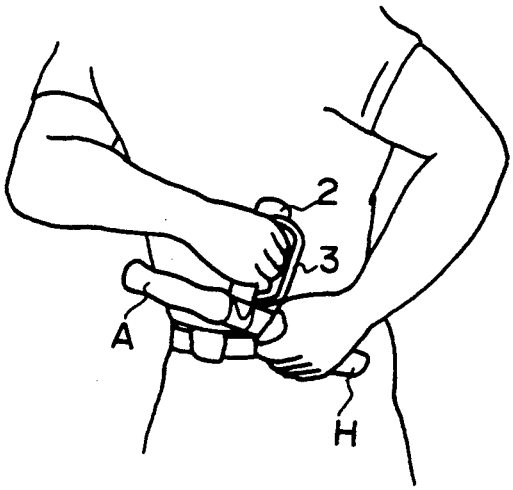
Figure 10:
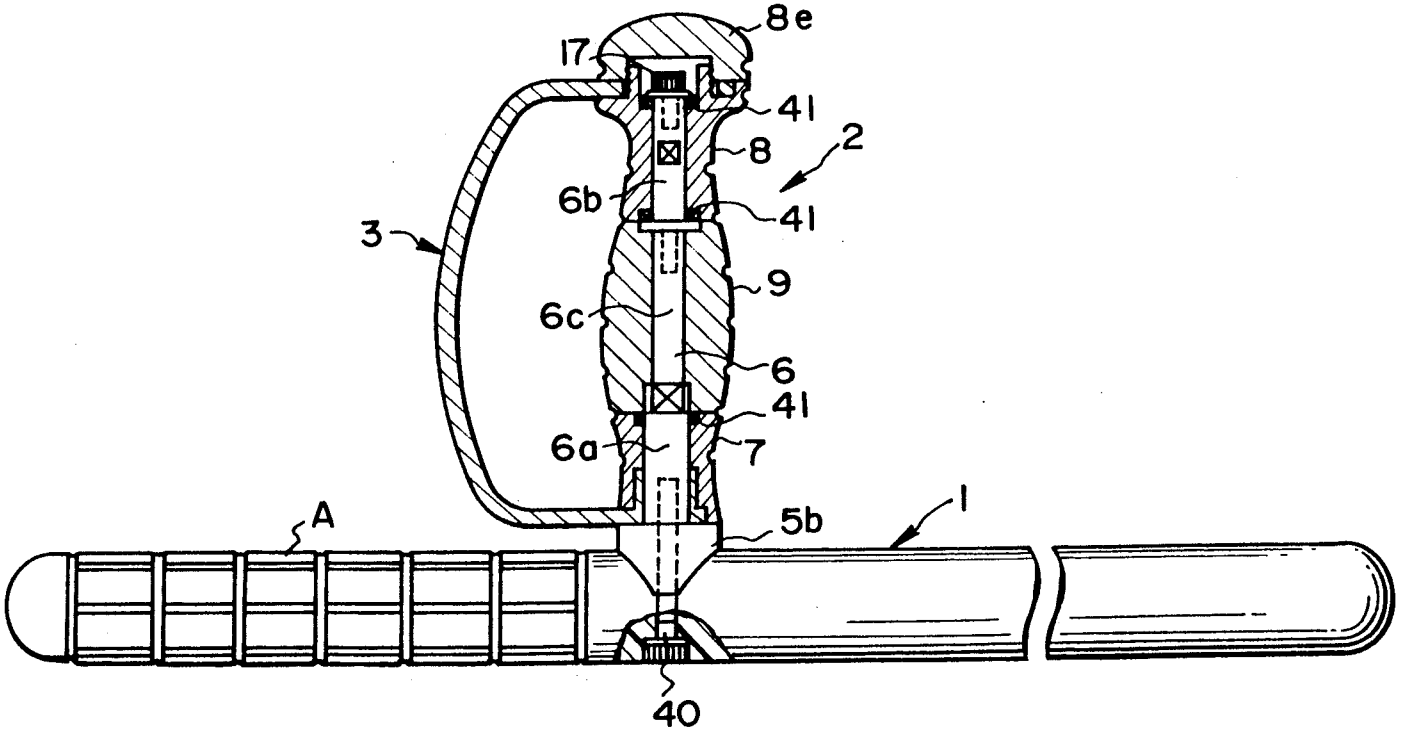
Figure 11:
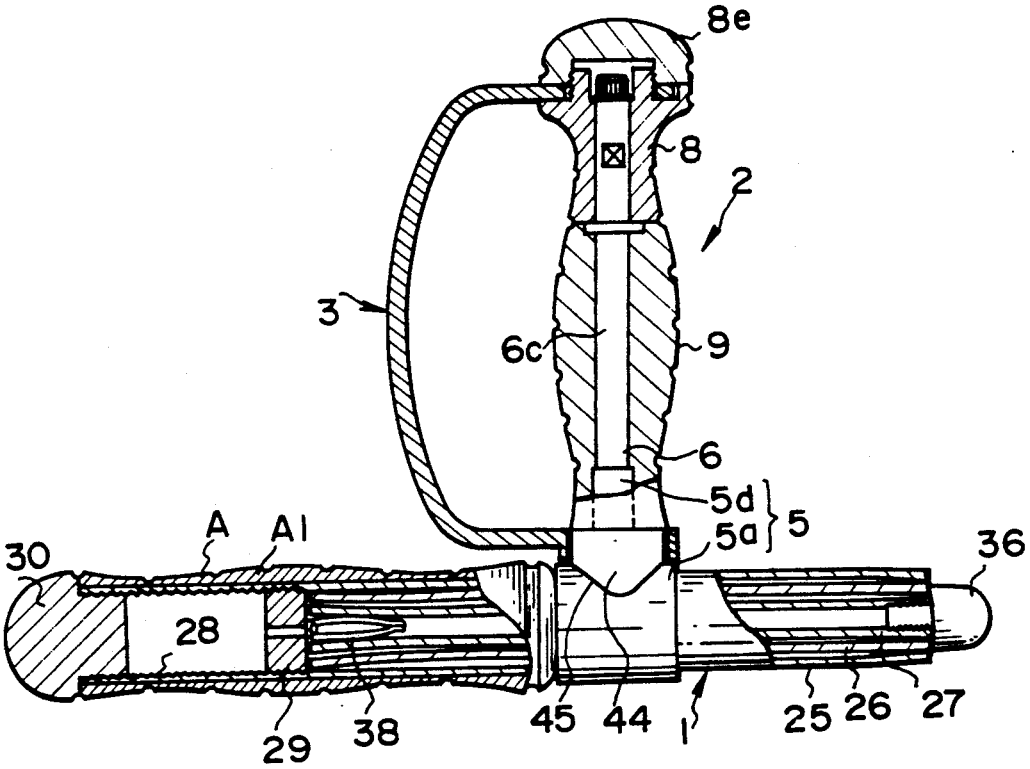
Figure 12:
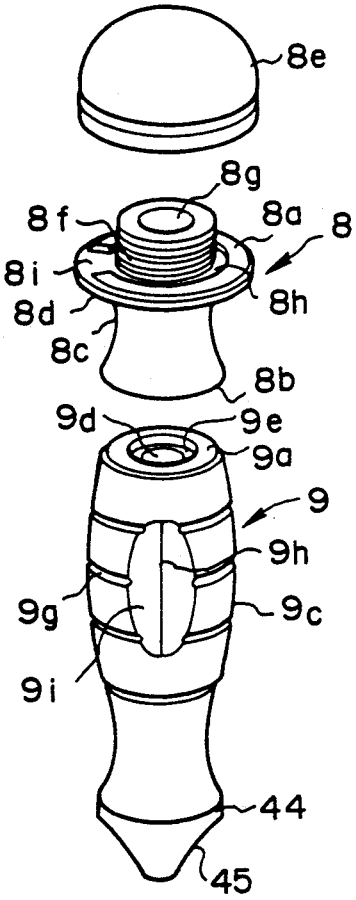
Figure 13:
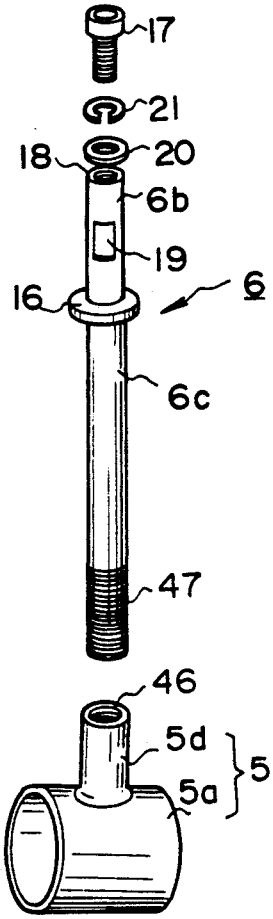
Figure 14:
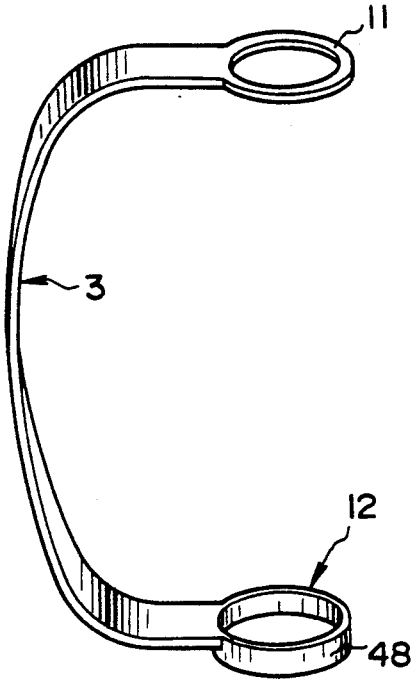
Figure 15:
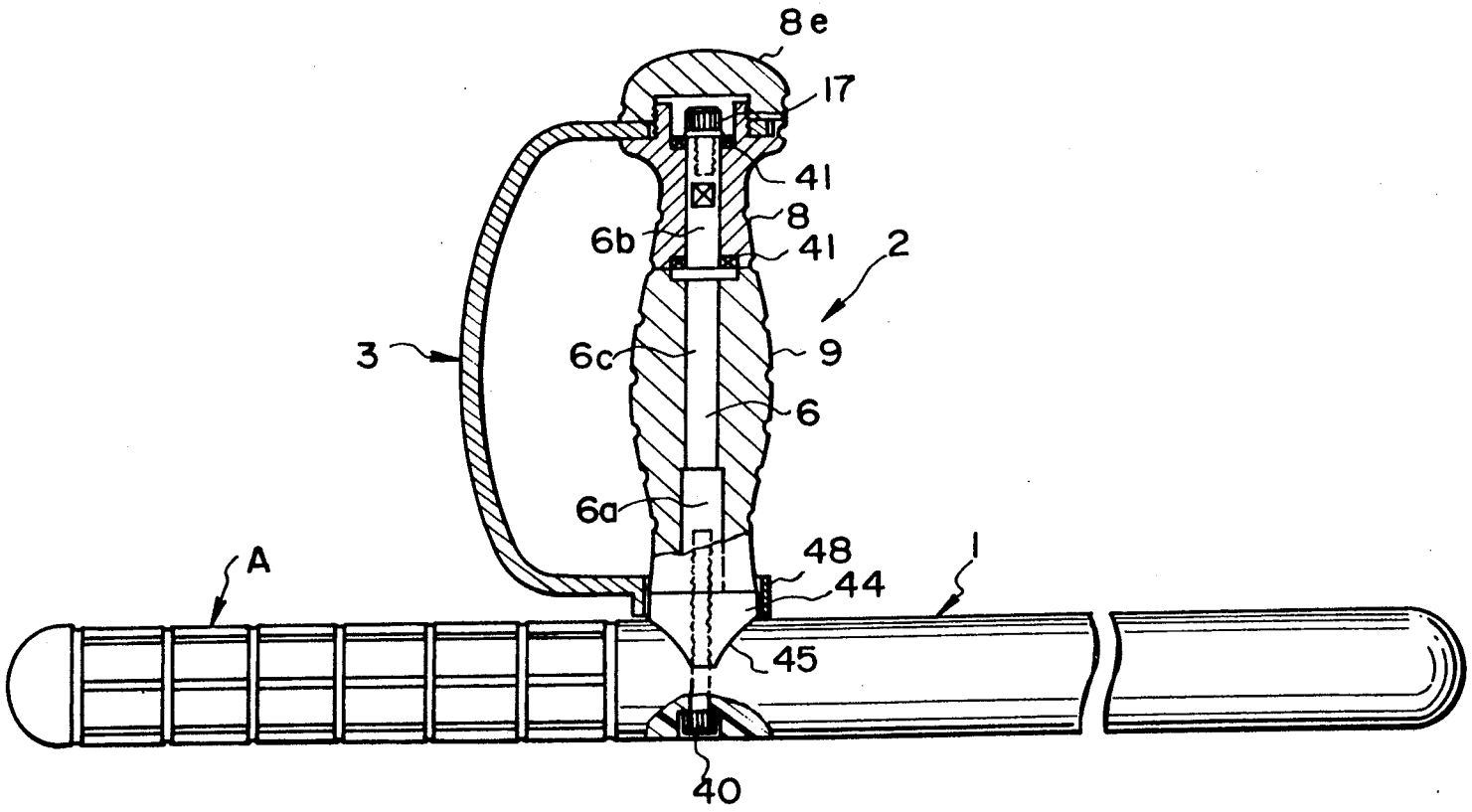
Figure 16:
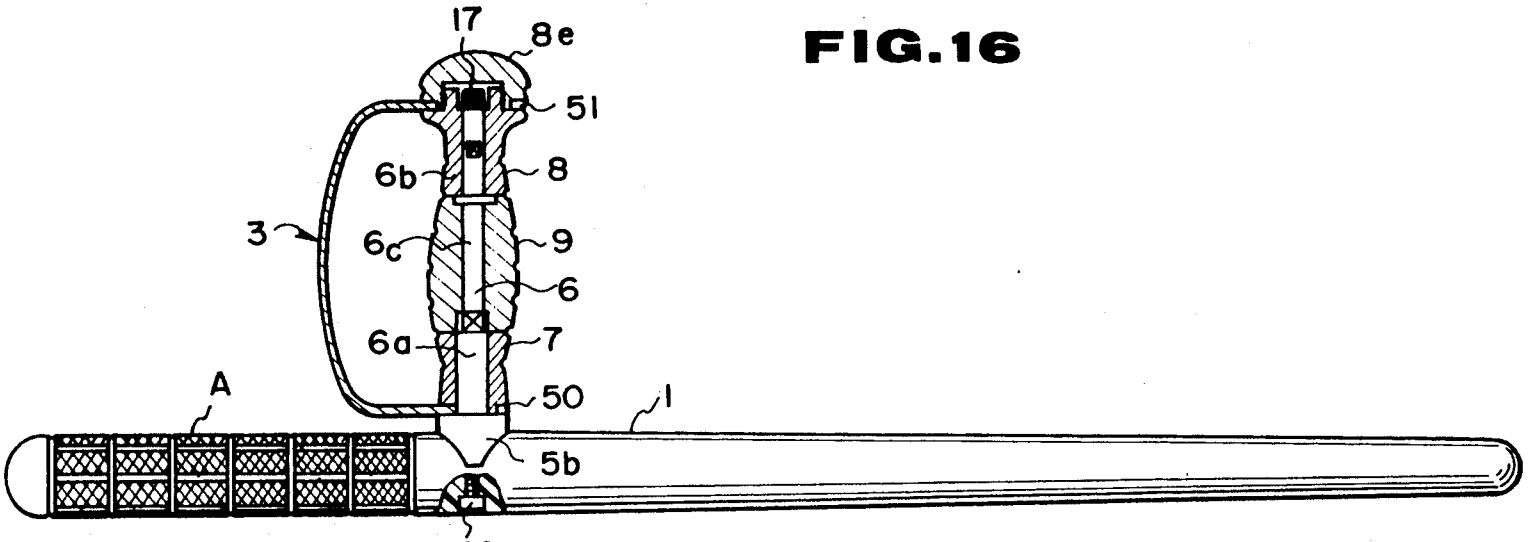
Figure 18:
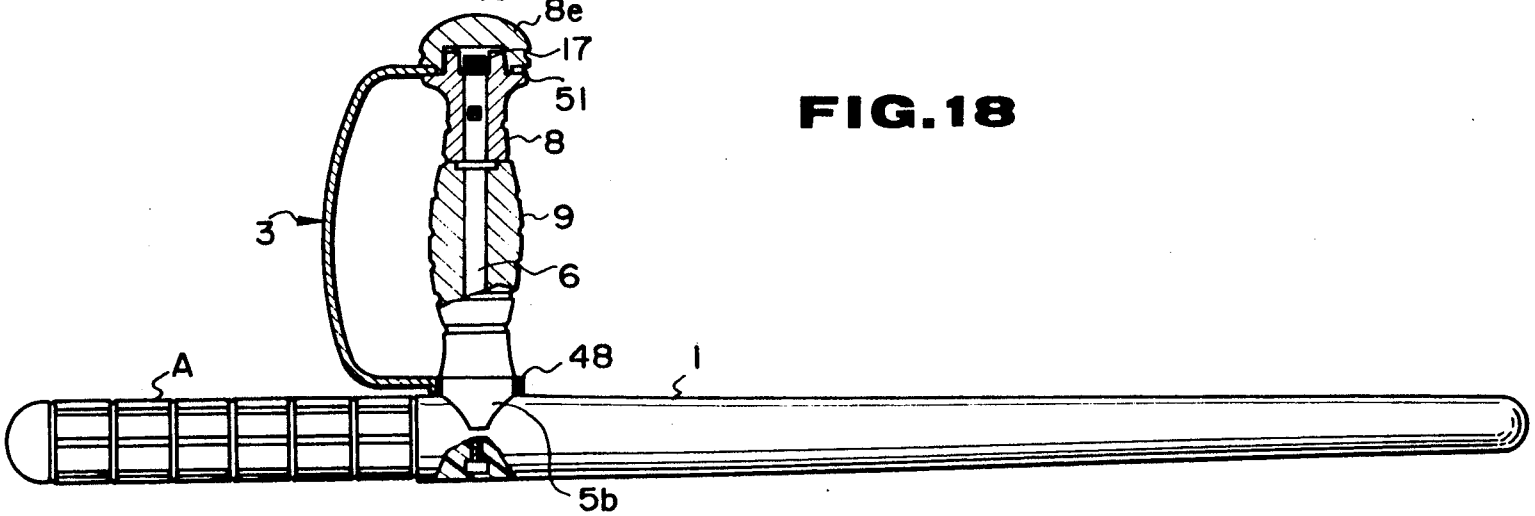
Figure 17:
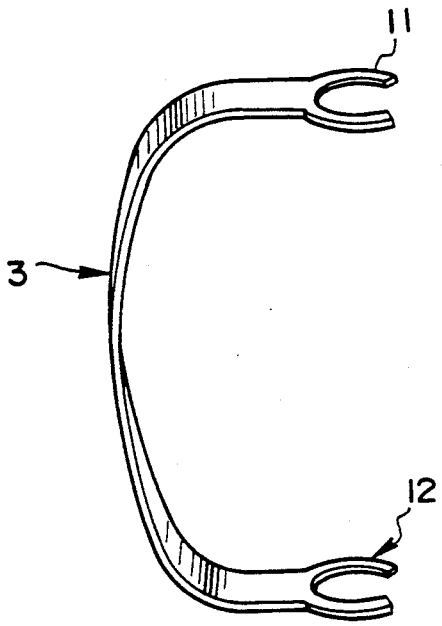
Figure 19:
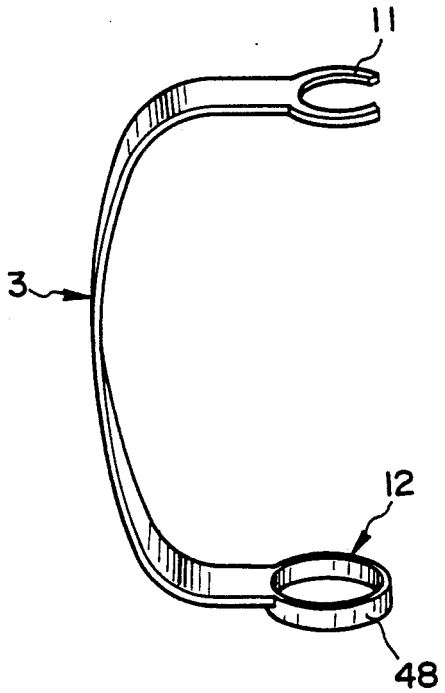
Figure 20:
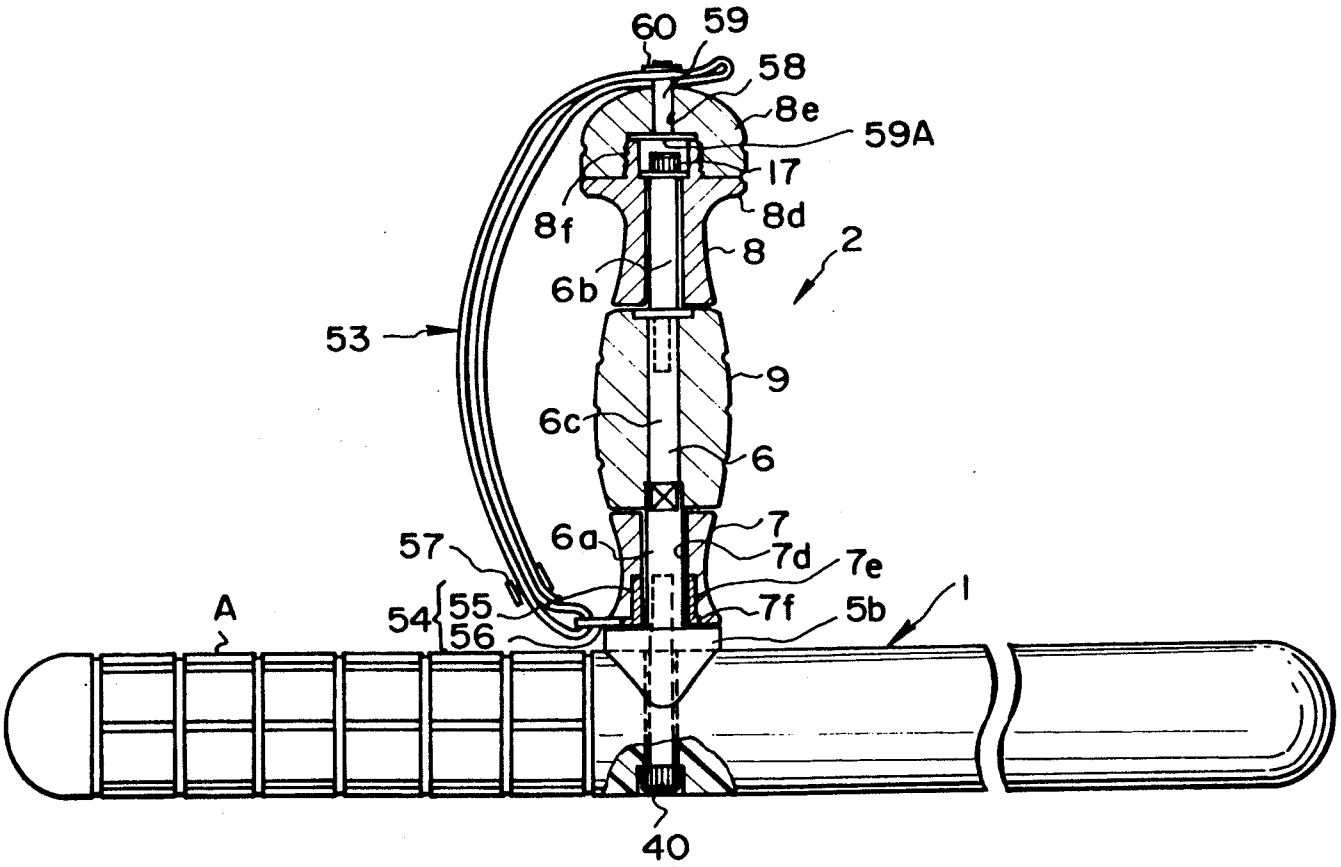
Figure 21:
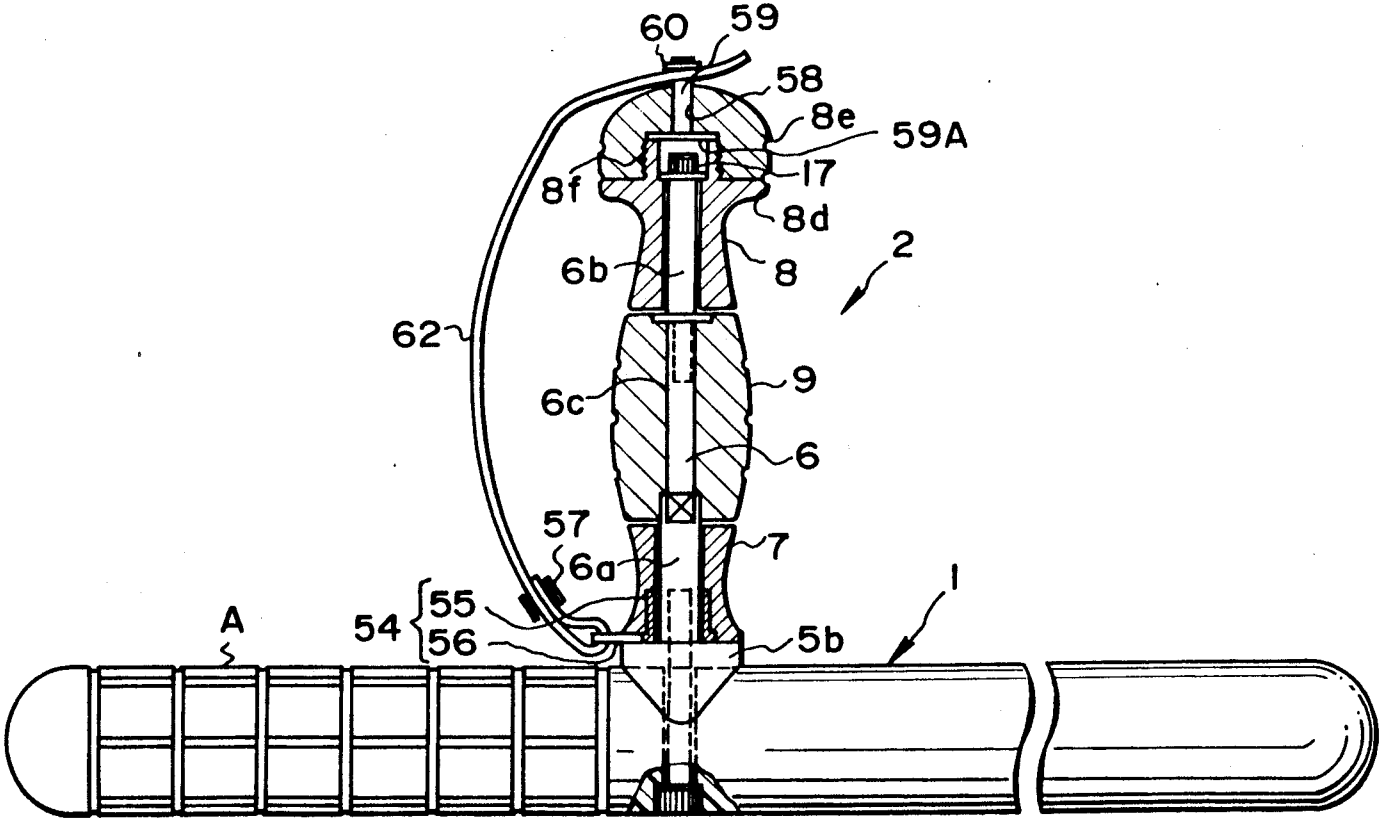
Figure 22:
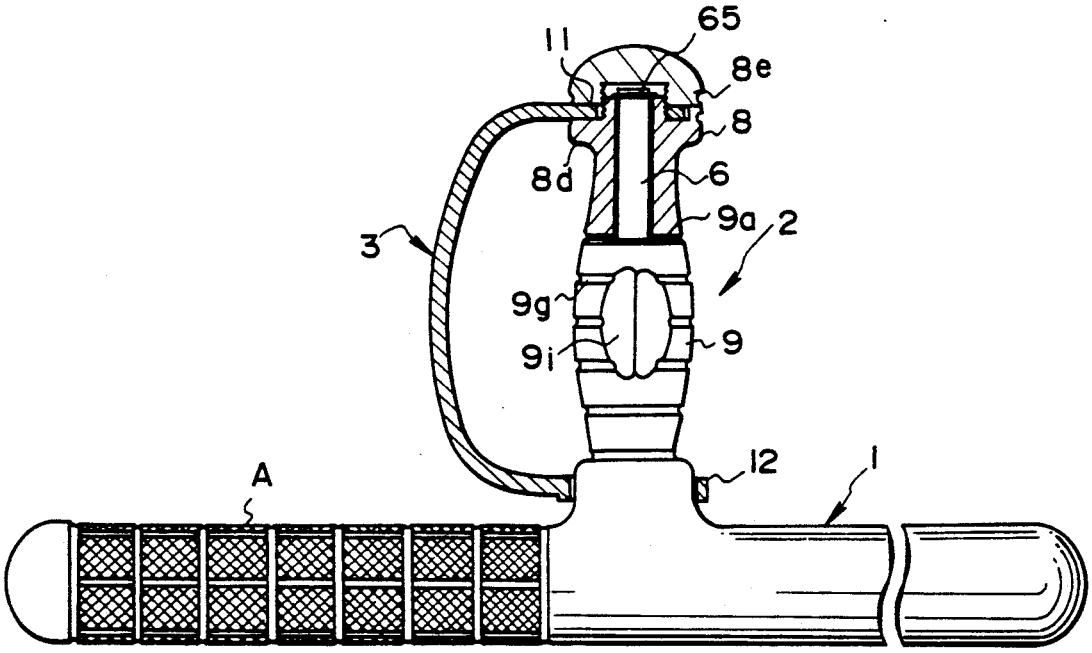

FIGS. 7(*a*)–(*c*) and FIGS. 8(*a*)–(*b*) are view, respectively, illustrating the mode of using the police baton with crosshandle shown in FIG. 1;

FIGS. 9(*a*)-(*d*) are views also illustrating another mode of using the police baton with crosshandle shown in FIG. 1;

FIG. 10 is a side elevational view partly in vertical cross section of a second embodiment according to the present invention;

FIG. 11 is a side elevational view partly in vertical cross section of a third embodiment according to the present invention;

FIG. 12 is an exploded perspective view for a gripping portion of the crosshandle shown in FIG. 11;

FIG. 13 is an exploded perspective view for a shank shown in FIG. 11;

FIG. 14 is a perspective view for a hand guard component shown in FIG. 11;

FIG. 15 is a side elevational view partly in vertically cross section of a fourth embodiment according to the present invention;

FIG. 16 is a side elevational view partly in vertically cross section of a fifth embodiment according to the present invention;

FIG. 17 is a perspective view for a hand guard component shown in FIG. 16;

FIG. 18 is a side elevational view partly in vertically cross section of a sixth embodiment according to the present invention;

FIG. 19 is a perspective view for a hand guard component shown in FIG. 18;

FIG. 20 is a side elevational view partly in vertically cross section of a seventh embodiment according to the present invention;

FIG. 21 is a side elevational view partly in vertically cross section of an eighth embodiment according to the present invention; and FIG. 22 is a side elevational view partly in vertically cross section of a ninth embodiment according to the present invention.

DESCRIPTION OF THE PREFERRED EMBODIMENT

The present invention will now be described by way of its preferred embodiments with reference to the accompanying drawings.

FIG. 1 through FIG. 6 illustrate a first embodiment of the present invention. In the drawings, reference numeral 1 denotes a baton main body. The baton main body 1 in this embodiment is made extensible in a telescopic manner as described later and, when it is fully extended, it has a length L as shown by the dotted chain in FIG. 1. A crosshandle 2 is disposed to the baton main body 1 at a position between the longitudinal center and one end of the baton main body 1. That is, the baton main body 1 has the crosshandle of such a sufficient length that can be gripped by one hand at a position near a grip A disposed at one end of the baton main body 1. The grip A comprises a cylindrical body A1 made of a synthetic resin, wood or light weight metal material to which the baton main body 1 is inserted. The cross handle 2 has a hand guard 3 attached thereto which is rotatable relative to the baton main body 1, around the cross handle 2 as a center of rotation.

Figure 2:
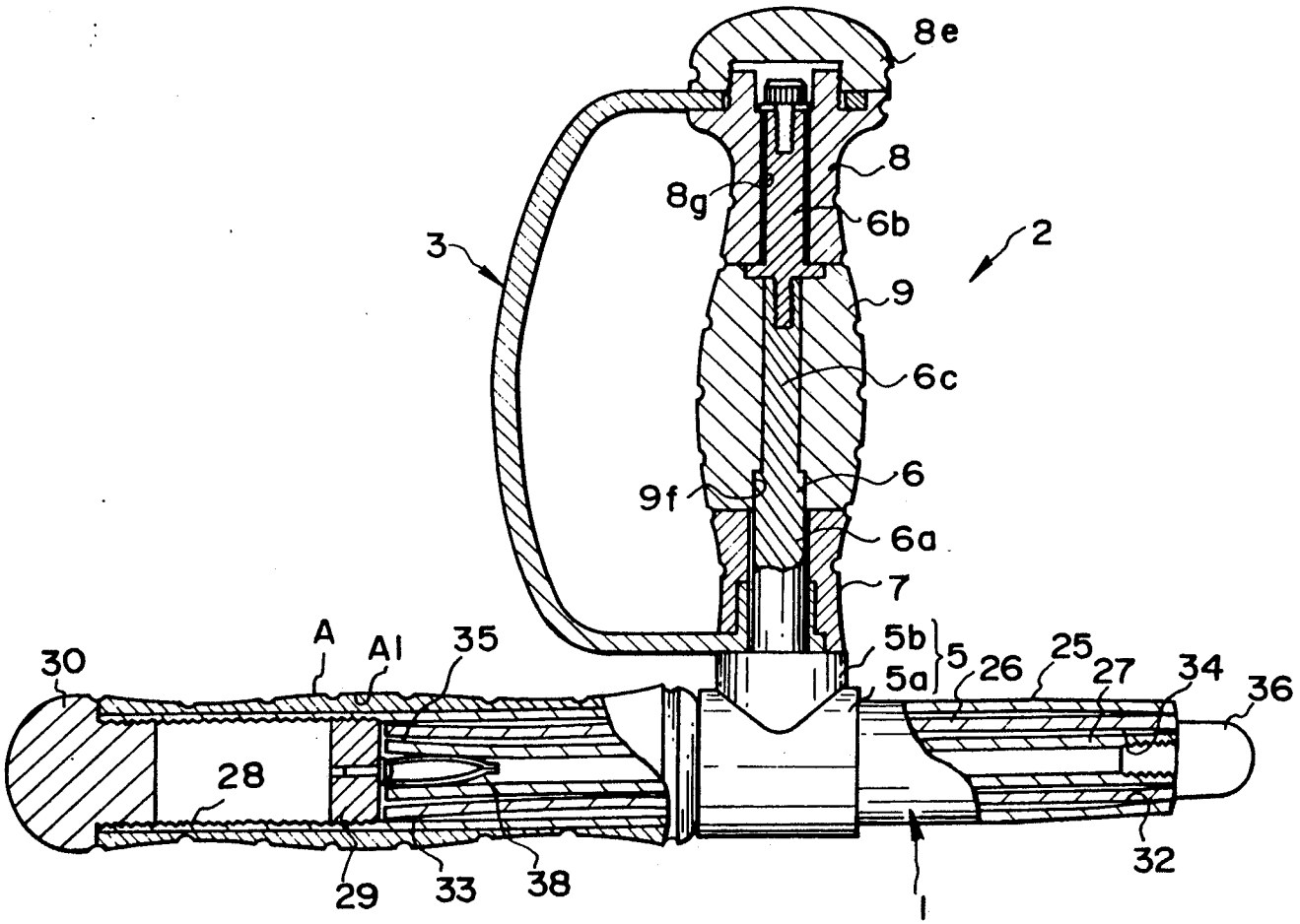
FIG. 2 is a side elevational view partially in vertical cross section of the embodiment shown in FIG. 1.

As shown in FIG. 2, the cross handle 2 has a shank 6 extending vertically, relative to the baton main body 1, from a mounting base 5 to be secured to the baton main body 1, and further comprises a relatively rotational lower member 7 slidably fit to the base end 6*a* of the shank 6, a relatively rotational upper member 8 slidably fit to the top end 6*b* of the shank 6 and a static member 9 through which an intermediate portion 6*c* of the shank 6 is inserted and which is secured to the shank 6 at a position being put between the relatively rotational upper and lower members 7 and 8.

Figure 3:
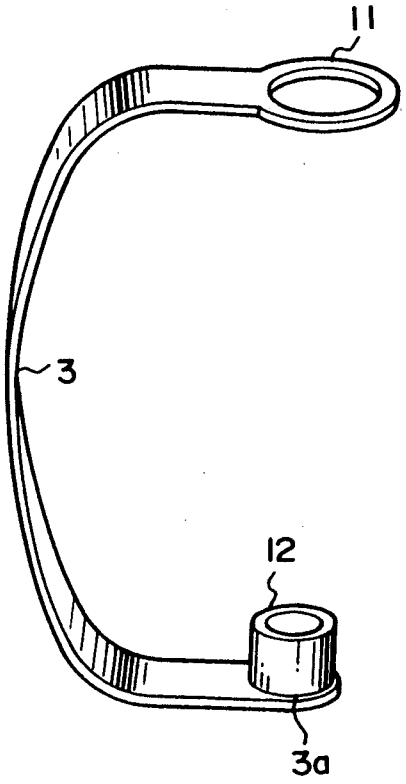
FIG. 3 is a perspective view of a hand guard component shown in FIG. 2.

As shown in FIG. 3, the hand guard 3 is made, for example, of metal or plastic material formed generally in a C-shaped configuration. It has an upper end in the form of an annular upper attaching portion 11 formed at the upper end for securing to the relatively rotational upper member 8 and a cylindrical lower attaching portion 12 formed at the lower end 3*a* for securing to the relatively rotational lower member 7. The hand guard 3 is detachably mounted to the cross handle 2 by way of the upper and lower attaching portions 11 and 12.

Figure 4:
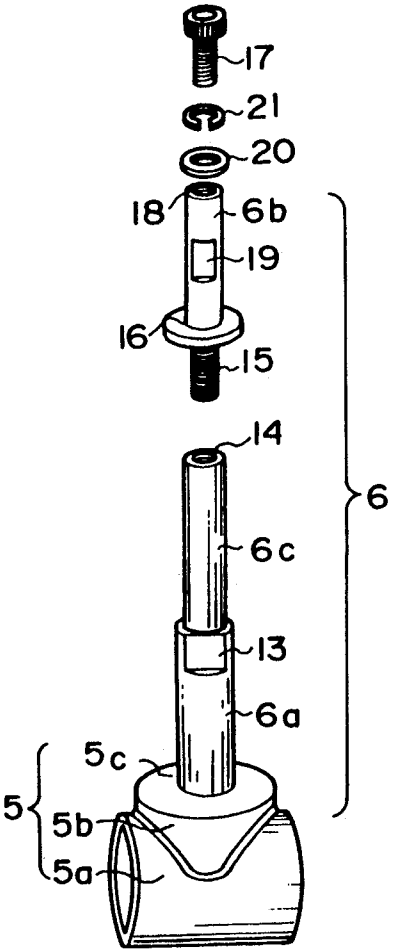
FIG. 4 is an exploded perspective view of a shank shown in FIG. 2.
Figure 5:
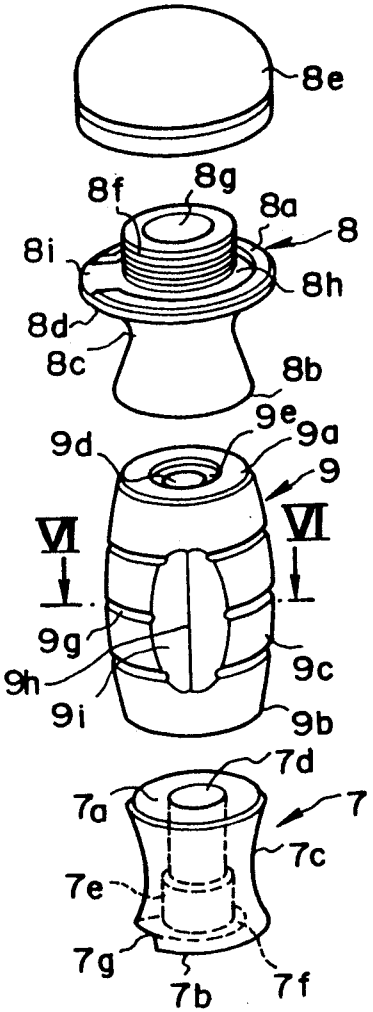
FIG. 5 is an exploded perspective view for a gripping portion of a crosshandle shown in FIG. 2.

Description will further be made in details to the cross handle 2 while referring to exploded perspective views of FIG. 4 and FIG. 5.

As shown in FIG. 4, in the shank 6 of this embodiment, the mounting base 5 comprises a cylindrical member 5*a* and a saddle-shaped metal member 5*b* secured to the outer circumferential surface thereof. The mounting base 5 is mounted to the baton main body 1 shown in FIGS. 1 and 2 from the end to which the grip A is tightly fit. That is, the cylindrical member 5*a* is inserted from one end of the baton main body 1 and forced into the stepped portion of the baton main body 1 at which the outer diameter of the baton main body 1 is made somewhat larger (not shown). In this case, the mounting base 5 can be shrink fit under heating. Subsequently, the grip A is joined with the baton main body 1 by inserting the latter. The mounting base 5, thus fit firmly to the baton main body 1, has an upper flat surface 5*c*, on which the base end 6*a* of the shank 6 of the largest diameter stands vertically at the center. The upper portion of the base end 6*a* is chamfered on the circumferential side to form a flat surface 13 for inhibiting the rotational movement of the static member 9.

Further, the shank 6 has an intermediate portion 6*c* formed integrally therewith at a diameter slightly smaller than that of the base end 6*a* and extended upward from the upper end face of the base end 6*a*. The portion 6*c* has internal female threads 14 at its upper portion. The shank 6 further has a top end 6*b* having, at its lower portion, male threads 15 for thread-coupling with the female threads 14 in the intermediate portion 6*c* and a flange 16 diametrically enlarged in the form of a disc, and at its upper portion, internal female threads 18 for thread-coupling with a bolt 17. There are also shown a chamfered flat surface 19 to be caught by a wrench, a flat washer 20 and a spring washer 21.

FIG. 5 is an exploded perspective view for a grip member, in which the relatively rotational lower member 7 is flattened at the upper surface 7*a* and the lower surface 7*b* and an inwardly concaved at the outer circumferential surface 7*c*, as well as a through hole 7*d* is formed at the axial center for slidably fitting the base end 6*a* of the shank 6. The inner diameter of the through hole 7*d* is enlarged in the lower portion to form a hand guard attaching bore 7 for fitting the outer diameter of a cylinder of the lower attaching portion 12 of the hand guard 3. Further, the lower surface 7*b* of the rotational member 7 has a recessed groove 7*f* for receiving the lower end 3*a* of the hand guard 3 and a side opening 7*g* for the recessed groove 7*f*.

Figure 6:
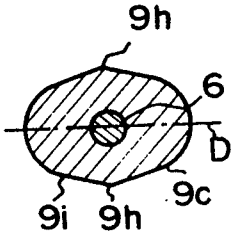
FIG. 6 is a cross sectional view taken along lines VI—VI in FIG. 5.

The static member 9 is flattened at an upper surface 9*a* and a lower surface 9*b* and an externally convexed at the outer circumferential surface 9*c*, as well as a through hole 9*d* is formed at the axial center thereof for permitting the intermediate portion 6c of the shank 6 to pass therethrough. A recess 9e is formed to the upper portion of the through hole 9d for receiving the flange 16 of the intermediate portion 6c of the shank 6, while a long hole 9f is formed to the lower portion (refer to FIG. 2) having a surface for receiving the flat surface 13 at the upper end of the base end 6a of the shank 6. In addition, a plurality of recessed grooves 9g are formed to the outer circumferential surface 9c for preventing the gripping hand from slipping. Further, as shown in FIG. 6, a middle portion of the outer circumferential surface 9c is so formed that it has a substantially elliptic transversal cross section and constitutes a gripping surface 9i chamfered such that the intersection 9h between the shorter diameter of the elliptic shape and the convexed outer circumferential surface 9c slightly ridged outwardly. It is further adapted such that when the static member 9 is attached to the shank 6, the flat surface 13 of the base end 6a of the shank 6 fits the flat surface of the long hole 9f formed to the lower surface 9b of the static member 9, so that the longer diameter D of the elliptic cross section of the static member 9 is aligned with the axial direction of the baton main body 1.

The upper relative rotational member 8 is flattened at an upper surface 8a and a lower surface 8b, and the outer circumferential surface 8c thereof is gradually reduced diametrically from the lower end upwardly and suddenly enlarged at the upper portion to form a retaining portion 8d for preventing downward slippage. The retaining portion 8d has such a diameter as to ensure a sufficient retention when the outer circumferential surface 8c is gripped with a thumb and a forefinger being positioned there around. The upper surface 8a just above the retaining portion 8d has male threads 8f protruded therefrom for thread-coupling with an upper cap 8e, and has a through hole 8g in the axial center for slidably fitting the top end 6b of the shank 6. In the upper surface 8a, a recessed groove 8h for receiving the upper attaching portion 11 of the hand guard 3 and an opening 8i for the groove 8h are formed to the base of the male threads 8f.

The cross handle 2 and the hand guard 3 are assembled by the following sequence. (1) The lower attaching portion 12 of the hand guard 3 is slidably fit around the base end 6a of the shank 6. (2) The relatively rotational lower member 7 is slidably fit to the base end 6a, the lower attaching portion 12 of the hand guard 3 is fit into the hand guard attaching hole 7e and the lower end 3a of the hand guard 3 is fit to the recessed grove 7f and the side opening 7g. (3) The static member 9 is slidably fit around the intermediate portion 6c of the shank 6, and the flat surface 13 formed in the upper portion of the base end 6a is fit into the long hole 9f to inhibit the self-rotation of the static member 9. Thus, the static member 9 is integrally secured to the base end 6a of the shank 6. (4) Then, the male threads 15 at the top end 6b of the shank 6 are thread-coupled with the female threads 14 at the intermediate portion 6c. (5) The relatively rotational upper member 8 is slidably fit around the top end 6b of the thus fixed shank. (6) The upper attaching portion 11 of the hand guard 3 is fit into the recessed groove 8h and the opening 8i in the upper surface of the relatively rotational upper member 8. (7) The bolt 17 is thread-coupled with the female threads 13, by way of the flat washer 20 and the spring washer 21, so that the relatively rotational upper member 8 is rotatably attached to the top end 6b of the shank 6. Finally, the upper cap 8e is thread-coupled with the female threads 8f of the relatively rotational upper member 8.

Referring then to the baton main body 1 of this embodiment, it comprises a plurality (three in this embodiment) of cylindrical members 25, 26 and 27 each having different diameters and combined in an extensible or telescopic structure. The outer cylinder 25 of the largest diameter has female threads 28 formed on the side of the rear end at the inner circumferential surface from the opening toward the axial inside. It also has a plug 29 having outer circumferential threads threaded to the axial inside thereof and a cap 30 threaded to the opening at the rear end. The top end of the outer cylinder 25 has an inclined surface 32 at least at the inner surface and the inner diameter is slightly reduced toward the opening at the top end. The intermediate cylinder 26 contained at the inside of the outer cylinder 25 has an inclined surface 33 on the side of the rear end at least at the outer surface, and the outer diameter is slightly enlarged toward the opening at the rear end. The inclined surface 33 engages the inclined surface 32 formed at the inner surface of the opening at the top end of the outer cylinder 25. The top end of the intermediate cylinder 26 has an inclined surface 34 formed at least at the inner surface thereof and the inner diameter is slightly reduced toward the opening of the top end. An inner cylinder contained at the inside of the intermediate cylinder 26 has an inclined surface 35 formed at least at the outer surface on the side of the rear end and the outer diameter thereof is slightly enlarged toward the opening of the rear end. The inclined surface 35 engages the inclined surface 34 at the inner surface of the opening at the top end of the intermediate cylinder 28. Female threads are formed to the inner surface of the opening at the top end of the inner cylinder 27, and a cap 36 is threaded thereto. The inner cylinder 27 engages at its rear end to a forked spring 38 threaded to the plug 29.

In a state where each of the cylinders 25, 26 and 27 is contained successively as shown in FIG. 2, when a rotating force is applied to the baton main body 1 by gripping the crosshandle 2, for instance, the intermediate cylinder 26 and the inner cylinder 27 are delivered outwardly by a centrifugal force and extended in a state shown by the dotted chain lines in FIG. 1. In this case, the inclined surface 33 at the rear end of the intermediate cylinder 26 delivered from the outer cylinder 25 firmly engages the inclined surface 32 at the top end of the outer cylinder 25, while the inclined surface 35 at the rear end of the inner cylinder 27 delivered from the intermediate cylinder 26 firmly engages to the inclined surface 34 at the top end of the intermediate cylinder 26 and they are inhibited from slipping out. The angle of inclination for each of the inclined surfaces 32, 33, 34 and 35 is set such that engagement between each of the inclined surfaces is released and they can be contracted into the state shown in FIG. 2 by applying an external force greater than a predetermined level in the opposite direction to the top end of the baton main body 1 in the extended state. It is designed such that the base of the cap 36 at the top end of the inner cylinder 27 has a size large enough to retain the top end of the intermediate cylinder 26, and the forked spring 38 has a resiliency strong enough to prevent the intermediate cylinder 26 and the inner cylinder 27 from accidentally slipping out by a slight force (for instance, a force slightly greater than the weight of both of the cylinders 26 and 27).

However, the anti-slip mechanism is not necessarily restricted to the forked spring 38 but it may be a spring of another shape or a magnet.

OPERATION OF THE BATON

The police baton with the crosshandle according to this embodiment is compact and convenient to carry about in a contracted or shortened state as shown by the solid line in FIG. 1. It can be handled freely during training and can serve as an effective self-defensive tool. the user can use the baton as if it were a sword by gripping the grip A at the end of the baton main body 1, but it will be further effective to use it while rotating the baton main body 1 by gripping the crosshandle 2. In this case, a user grips the baton by positioning the user's thumb and forefinger of one hand around the outer circumferential surface 8*c* of the relatively rotational upper member 8 of the crosshandle 2 (refer to FIG. 8). The little finger is positioned for gripping around the relatively rotational lower member 7 of the crosshandle 2. The gripping force other than that of the thumb, the forefinger and the little finger is loosened and the baton main body 1 is rotated around the shank 6 of the crosshandle 2 as the center by the operation of the arm and the wrist. In this case, the thumb and the forefinger, firmly holding the relatively rotational upper member 8 of the crosshandle 2, are engaged against the retaining portion 8*d* to be prevented from detachment. On the other hand, the static member 9 of the crosshandle 2 is rotated together with the baton main body 1 within a loosened palm.

In the existent crosshandle, in which only the lower portion is made rotatable, the rotatable member of the lower portion is held by the little finger. However, since it is held only by the force of the little finger which is weaker than that of the other fingers, upon rotating the baton main body 1, the police baton is liable to slip off downward by its own weight and the gripping hand on the cross-handle 2 is gradually displaced toward the upper portion of the handle, which causes the little finger to be detached from the lower rotatable portion. For always holding the lower rotatable portion by the little finger, it is necessary for a user to put it under his arm for re-gripping the crosshandle 2, on every once or twice rotating operation of the baton main body 1, and apply the rotating manipulation again. This is extremely disadvantages in an imminent situation requiring quick offense and defense motion.

On the contrary, in this embodiment, the retaining portion 8*d* of the relatively rotational upper member 8 prevents the downward slip. In addition, the knuckle of the hand that grips the crosshandle 2 is situated on the inside of the hand guard 3 and the downward slip can be prevented also by this hand guard 3 even if the hand should slip. Accordingly, it is possible to quite freely swing or rotate the baton main body 1. The hand guard 3 is engaged by the relatively rotational lower member 7 and the relatively rotational upper member 8 and is always independent, together with both of the relatively rotational members, of the rotational movement of the baton main body 1. That is, the knuckle portion of the hand can always be protected by the hand guard 3 however the baton main body 1 is rotated by the gripping the crosshandle 2.

The method of using this police baton will now be described referring to one example. For instance, as shown in FIGS. 7(*a*)–(*c*), if an opponent X attacks by using a rod S or the like a user Y having the police baton quickly swings an arm holding the crosshandle 2 of the police baton T with crosshandle forwardly from the opposite side, to rotate the baton main body 1. The intermediate cylinder 26 and the inner cylinder 27 of the baton main body 1 are rapidly extended by the centrifugal force of the rotation as shown in FIG. 8(*a*) to sweep off the rod S swung down by the opponent X. In this case, since the hand guard 3 is directed to the opponent, even if it should fail to sweep off the rod S, the hand of the user Y gripping the crosshandle 2 can be protected against the hit of the rod S. At the same time, the user Y takes a step and, while breaking the opponent's balance by the left hand, moderates the gripping force of the hand firmly gripping the static member 9 of the crosshandle 2 to let free the static member 9 of the crosshandle 2. The relatively rotational upper member 8 and the relatively rotational lower member 7 are fixed within the hand while being gripped, and the static member 9, the baton main body 1 and the shank 6 are integrally rotated continuously around the shank 6 as the center. When the top end of the baton main body 1 comes to the right side, the static member 9 is firmly gripped again to control the rotation of the baton main body 1. Thus, since the cap 30 at the rear end of the grip A of the baton main body 1 is directed forward and just opposed to the opponent X, if the baton main body 1 is thrusted forward with the entire crosshandle 2 being kept gripped firmly, it is possible to hit and down the opponent Y by the end of the bat. Since the hand guard 3 is secured in the hand and kept as it is together with the relatively rotational upper member 8 and the relatively rotational lower member 7 to the opponent X, the knuckle of the forwarded arm can be protected effectively.

In the operation described above, the longer diameter of the static member 9 of the crosshandle 2 generally in the elliptic cross sectional shape is always aligned with the axial direction of the baton main body 1. Accordingly, the attitude or the state of the baton main body 1 can be felt by the hand that grips the static member 9 under rotation together with the baton main body 1, and the pointing direction of the baton can be controlled extremely easily. Further, by tightly gripping the gripping surface chamfered into the shape of a ridge formed on the outer circumferential surface of the static member 9, it is also easy to apply breaking on the rotation of the static member 9, and, thus, the rotation of the baton main body 1 to suddenly stop it and the police baton can be manipulated simply even by a beginner.

Since the baton main body 1 in this first embodiment has a telescopic structure, the intermediate cylinder 26 and the inner cylinder 27 are enhoused within the outer cylinder 25 as shown in FIG. 2 in an ordinary state and the baton is convenient to carry about, for example, by being placed in a holster and put on the side of a user's waist like that of a hand gun without being noticed from the outside.

Further, as shown in FIG. 9(*a*), in a case where the baton main body 1 of the police baton with cross handle is contained in a holster H and suspended from the right side of the waist with the crosshandle 2 being directed horizontally, the band guard 3 is spontaneously directed downward by its own weight. Accordingly, the user can perform a unique method of using the police baton, i.e., so-called "quick draw" of swiftly gripping the cross handle 2 by his right hand at any time with no hindrance of the hand guard 3 and turning back the user's wrist as shown in FIG. 9(*b*) while drawing out the baton main body 1 from the holster H to quickly project the intermediate cylinder 26 and the inner cylinder 27. In a case of suspending the holster H from the left side of the waist, the baton is contained in the holster H with the crosshandle 2 being directed substantially rearward and horizontally as shown in FIG. 9(*c*). Upon drawing the baton, it is drawn out from the holster H by gripping the crosshandle 2 by the right hand while inducing the baton main body 1 to the horizontal direction by the left hand as shown in FIG. 9(*d*) and it is then thrusted as shown in FIG. 8(*a*). When the user gets skilled in these maneuvers, if an opponent comes closer with a weapon such as a hand gun at the ready, it is possible to instantly sweep off the weapon, and this is a great advantage inherent to the police baton with cross handle of the telescopic structure according to the present invention.

The present invention will further be explained referring to other embodiments. In each of the following embodiments, identical or corresponding portions with those in the previous embodiment carry the same reference numerals, for which duplicate descriptions are to be omitted.

FIG. 10 shows a second embodiment.

The baton main body 1 of this embodiment has a non-telescopic structure, different from the first embodiment described previously, and it is made of a wood, metal or synthetic resin material. In a case of using wood, it may be reinforced by using such means as impregnation of a synthetic resin. In a case of using synthetic resin, it may be prepared as a molding product by using a so-called reinforced plastic material which is reinforced, for example, by synthetic fibers such as alamide, nylon or polyester, or glass fibers or carbon fibers. The baton main body 1 comprises a rod-shaped member having a solid or hollow portion having a diameter substantially identical at least from the position for the crosshandle 2 to the top end. For the convenience of carrying about or transporting it, divisional components may be prepared separately and integrally joined with each other by means of screws. By forming the baton main body 1 as described above, a merit can be obtained in view of manufacture that the fabrication of the baton main body 1 is easy, mass production is possible and the cost can be reduced.

The crosshandle 2 is different from the first embodiment in view of the mounting structure to the baton main body 1. That is, the mounting base for the shank 6 comprises only a saddle-shaped metal 5*b* and the saddle-shaped metal 5*b* is brought into a close contact with the outer circumferential surface of the baton main body 1 and screw-fastened to the baton main body 1 by a fastening bolt 40 that diametrically passes through the baton main body 1. This can provide a merit in view of handling that the crosshandle 2 can be attached and detached simply.

Further, a rolling bearing or a sliding bearing 41, made of a resin of low friction coefficient such as a fluoro resin or a polyamide resins is interposed to each of the relatively rotational lower member 7 and the relatively rotational upper member 8 of the crosshandle 2. This can provide a merit in view of function that the relative rotation of the relatively rotational lower member 7 and the relatively rotational upper member 8 can be made more smoothly and at a higher speed. Such a bearing can also be used in each of other embodiments although not illustrated particularly.

The function and the effect of the hand guard 3 are the same as those in the first embodiment described previously.

FIG. 11 through FIG. 14 show a third embodiment.

The crosshandle 2 of this embodiment, different from the first and the second embodiments described above, has only the upper rotational structure and the relatively rotational lower member 7 is omitted. That is, as shown in FIG. 12, the static member 9 constituting the crosshandle 2 is extended toward the lower end by a length corresponding to that of the relatively rotational lower member 7 in the first and the second embodiments and the circumference of the lower end is formed as a cylindrical surface 44 and the lower end face is formed as a saddle-shaped concaved surface 45.

Further, as shown in FIG. 13, the shank 6 for the crosshandle 2 has a mounting base 5 comprising a cylindrical member 5*a* and a base end 5*d* in the form of a small cylinder having internal female threads 46 and welded to and vertically erected from the outer circumferential surface of the cylinder 5*a*. The mounting base 5 is mounted to the baton main body 1 by the same manner as that in the case of the first embodiment. The intermediate portion 6*c* of the shank 6 has male threads 47 formed at its lower end portion, and the male threads 47 are threaded into the female threads 46 in the base end 5*d* secured to the mounting base end 5. The top end 6*b* of the shank 6 is formed, together with the flange 16 enlarged diametrically in the disc-like shape, integrally in continuous with the intermediate portion 6*c*.

As shown in FIG. 14, in the hand guard 3, the lower attaching portion 12 is formed as an annular ring 48 of a size slidably fitting to the cylindrical circumference 44 at the lower end of the static member 9.

The police baton is assembled by the following sequence. (1) The lower attaching portion 12 of the hand guard 3 is put around the base end 5*d* of the shank. (2) The static member 9 is fit to the base end 5*d* to bring the saddle-shaped concave a surface 45 into an intimate contact with the cylindrical surface of the cylinder 5*a*. Thus, the longer diameter of the elliptic cross section of the static member 9 is aligned with the axial direction of the baton main body 1. The annular ring 48 of the lower attaching portion 12 of the hand guard 3 is slidably fit around the cylindrical circumference at the lower end of the static member 9. (3) The intermediate portion 6*c* of the shank 6 is inserted into the through hole 9*d* from the upper surface of the static member 9 and the male threads 47 at its top end are thread-coupled with the female threads 46 formed in the base end 5*d*, to secure the static member 9 to the mounting base 5. (4) Then, the relatively rotational upper member 8 is fit around the top end 6*b* of the shank 6. (5) Subsequent procedures are the same as those in the first embodiment described previously.

Since the crosshandle 2 has no relatively rotational lower member 7 in this third embodiment, the structure of the crosshandle 2 can be greatly simplified. Further, the structure for attaching the hand guard 3 can also be simplified. Therefore, a merit of facilitating the manufacture and reducing the cost for the crosshandle 2 can be attained.

FIG. 15 shows a fourth embodiment.

In this embodiment, the non-telescopic baton main body 1 shown in FIG. 10 is combined with an upper rotational type crosshandle 2 comprising a relatively rotational upper member 8 and a static member 9 as shown in FIG. 12 (not having the relatively rotational lower member 7), to which a hand guard 3 as shown in FIG. 14 is attached. This can provide a merit in view of manufacture that the structure of the baton main body 1 and the crosshandle 2 is simple and the baton can be manufactured with ease in a mass production scale and at a reduced cost.

FIGS. 16 and 17 show a fifth embodiment.

This embodiment is similar to the second embodiment in that the baton main body 1 has a non-telescopic structure and the crosshandle 2 has a relatively rotational lower member 7 and a relatively rotational upper member 8 (shown in FIG. 10), but it is different from the second embodiment in that the baton main body 1 is continuously tapered gradually from the position for the crosshandle 2 toward the top end. This can provide a merit capable of preventing such a disadvantage that when a beginner rotates the baton main body 1 by gripping the crosshandle 2, it often hits against the elbow of the user himself and, accordingly, it is suitable for the beginner to get skilled in the manipulating method of the police baton with crosshandle.

Further, the hand guard 3 is different from each of the embodiments described above in view of the attaching structure. In this hand guard 3, each of the upper attaching portion 11 and the lower attaching portion 12 is formed into a retainer ring as shown in FIG. 17. The hand guard 3 is attached by inserting the lower attaching portion 12 into an annular hand guard attaching groove 50 formed to the relatively rotational lower member 7 of the crosshandle 2, and inserting the upper attaching portion 11 into the annular hand guard attaching groove 51 formed to the relatively rotational upper member 8. Accordingly, this can provide a merit capable of attaching and detaching the hand guard 3 almost in one-tough operation.

In the case of such a plug-in type hand guard 3, it is preferred that the hand guard 3 is made of material, particularly, highly resilient comprising metal, plastic, reinforced plastic or a combination thereof.

FIG. 18 and FIG. 19 show a sixth embodiment.

In this embodiment, the crosshandle 2 in the fifth embodiment is modified as an upper rotational structure having no relatively rotational lower member 7. Accordingly, the structure for attaching the hand guard 3 is different from that in the fifth embodiment described previously, and an annular ring 48 slidably fit to the base of the crosshandle 2 is disposed to the lower attaching portion 12 like that shown in FIG. 14.

FIG. 20 shows a seventh embodiment.

In this embodiment, the hand guard 3 in the second embodiment (shown in FIG. 10) is replaced with a ring-like belt member 53.

That is, the baton main body 1 is a non-telescopic solid or hollow member and a crosshandle 2 is thread-coupled by means of a fastening bolt 40 to the baton main body 1 by way of the saddle-shaped metal 5*b* in close contact with the outer circumferential surface of the baton main body 1. The crosshandle 2 has a structure comprising a relatively rotational lower member 7, a relatively rotational upper member 8 and a static member 9. The relatively rotational lower member 7, like that shown in FIG. 5, has a through hole 7*d* in which the base end 6*a* of the shank 6 is slidably fit, a hand guard attaching hole 7*e* of an enlarged inner diameter formed therebelow and a concaved groove 7*f*. Then, a hand guard attaching tool 54 as the lower attaching portion is fit into the hand guard attaching hole 7*e* and the concaved groove 7*f* and secured integrally rotatably. The hand guard attaching tool 54 has a tongue 56 at the lower end of a cylindrical member 55 and one end of the tongue 56 is protruded outwardly. A belt member 53 made, for example, of leather, plastic and woven fabric is inserted through a belt insertion hole (not illustrated) formed at the protruding end of the tongue 56, turned back into a ring-like form and then retained by a retainer 57 with the ends being overlapped to each other.

On the other hand, an upper cap 8*e*, thread-coupled with the relatively rotational upper member 8, has a through hole 58 formed therein, through which a hand guard setting pin 59 is inserted as the upper attaching portion. The hand guard setting pin 59 is secured by fitting a flat plate 59*a* at the lower end of the pin in the upper cap 8*e* and tightening the upper cap 8*e* to the male threads 8*f*. The hand guard setting pin 59 has a protruded upper end, at which a retaining ring or like other round flange 60 is disposed. The ring-like belt member 53 has a fixing portion comprising a (not illustrated) hole or recess formed to the free end thereof. The fixing portion is passed through the upper end of the hand guard setting pin 59 and secured detachably, so that the ring-like belt member 53 functions as the hand guard. Further, when the free end of the ring-like belt member 53 is detached from the hand guard setting pin 59 and used while passing the wrist therethrough, downward slipping of the baton can be prevented if the hand should detach from the crosshandle 2.

FIG. 21 shows an eighth embodiment.

In this embodiment, the ring-like belt member 53 in the seventh embodiment (refer to FIG. 20) is replaced with a non ring-like belt member 62, and the structure of the hand guard is more simple.

The fixing means on the side of the free end of the belt member 53, 62 in each of the seventh and the eighth embodiments is not restricted only to the hand guard setting pin 59 but hook or like other fastening means may be employed. In addition, the fixing means is not necessarily be fixed to the upper end of the upper cap 8*e*, but it may be secured detachably to somewhere in the relatively rotational upper member 8, such as at the midway of the upper cap 8*e* or just below the retaining portion 8*b* of the relatively rotational upper member 8.

FIG. 22 shows a ninth embodiment.

In the crosshandle 2 of this embodiment, the static member 9 is, together with the shank 6 protruding from the upper surface 9*a*, from a plastic material, integrally with the baton main body 1. A relatively rotational upper member 8 substantially identical with that shown in FIG. 5 is put around the shank 6 to be slidably fit rotatably and then retained from downward slip by the retainer ring 65. The upper attaching portion 11 of the hand guard 3 substantially identical with that shown in FIG. 14 is engaged to the relatively rotational upper member 8. The annular lower attaching portion 12 of the hand guard 3 is rotatably fit slidably to the base of the static member 9. This embodiment has the most simple structure among each of te embodiments and is suitable to mass production.

In each of the embodiments described previously, the relatively rotational upper member 8 is attached to the top end 6*b* of the shank 6 by screw-coupling of the bolt 17 but it is not restricted only thereto and, for example, a retainer ring as shown in FIG. 22 or like other known attaching means may also be used.

Further, as presented by the present applicant in the prior application, the top end of the baton main body 1 is made hollow and granular, rod-like or like other weight may be filled to the top end of the baton main body to increase the impact shock of the rotating baton main body 1 also in the police baton with crosshandle of the present application whether the structure of the baton main body 1 is telescopic or not.

Further, the baton main body 1 may be incorporated at the hollow portion thereof, for example, with an illumination device or a defensive gas jetting device. Alternatively, it is also possible to dispose a device for generating sound or jetting resin balls or colorants to falter, nap or momentarily surprise an opponent.

The present invention having thus been constituted as described above can provide the following advantageous effects.

Since a hand guard which is rotatable relative to the baton main body is attached, the gripping hand can always be protected effectively however the police baton with crosshandle is manipulated, thereby enabling to provide a more effective police baton capable of eliminating the weakness of existent police batons.

Since the relatively rotational member is disposed at least to the upper portion of the crosshandle and the hand guard is attached thereto, the hand guard can be rotated relatively smoothly, to enable smooth manipulation of the police baton with crosshandle.

Further, since the structure for attaching the hand guard is simple, it can be easily attached or detached as required and is convenient for transporting, carrying about or using it.

Further, if the baton main body is formed as a telescopic structure, it can be made compact in a not-used state to further facilitate transportation and carrying. In addition, a unique maneuver to surprise an opponent, for example, a "quick draw" is possible without interference by the hand guard, and this can provide an extremely effective weapon due to the synergistic effect with the hand guard.

On the other hand, if the non-telescopic structure is adopted for the baton main body, the manufacture is facilitated and mass production at a reduced cost is enabled. Further, when the baton main body is tapered toward the top end, even a beginner can be free from worrying that the user's elbow hits against the baton, by which the maneuverability can be improved.

Further, when the longer diameter of the cross section in the grip of the crosshandle is aligned with the axial direction of the baton main body, the pointing direction of the baton main body can be controlled easily, thereby enabling to provide a more effective police baton with further improved maneuverability

What is claimed is:

1. A police baton with crosshandle, comprising:
a baton main body;
a crosshandle branched perpendicular from the baton main body at a position longitudinally localized from a center to one end of the baton main body; and
a handle guard disposed to traverse a substantial length of the crosshandle and rotatably mounted relative to the baton main body so as to be rotatable around an axial center of the crosshandle.

2. A police baton with crosshandle as defined in claim 1, wherein the crosshandle comprises:
a mounting base to be secured to the baton main body,
a shank branched from the mounting base perpendicular to the baton main body,
a relatively rotational lower member which is slidably fit to a base end of said shank,
a relatively rotational upper member which is slidably fit to a top end of said shank, and
a static member disposed at an intermediate portion of the shank and secured thereto while being put between the relatively rotational upper and lower members, and
the hand guard engages at an upper attaching portion to said relatively rotational upper member and engages at a lower attaching portion to said relative rotational lower member respectively.

3. A police baton with crosshandle as defined in claim 2, wherein the hand guard has a generally C-shaped configuration in which the upper attaching portion is in a form of an annular ring or a retainer ring which is fit to the relatively rotational upper member of the crosshandle and the lower attaching portion is in a form of a cylinder or a retainer ring which is fit to the relatively rotational lower member of the crosshandle.

4. A police baton with crosshandle as defined in claim 2, wherein the hand guard comprises a belt member which is engaged at a base end to a lower attaching portion disposed integrally rotatably to the relatively rotational lower member and engaged at a free end to an upper attaching portion disposed integrally rotatably to the relatively rotational upper member.

5. A police baton with crosshandle as defined in claim 1, wherein the crosshandle comprises:
a mounting base to be secured to the baton main body,
a shank branched from said mounting base perpendicular to the baton main body,
a static member through which said shank is inserted and which is secured to said shank at a position adjacent with said mounting base, and
a relatively rotational upper member which is slidably fit to a top end of the shank at a position above the static member, in which the hand guard engages at an upper attaching portion to said relatively rotational upper member and is slidably fit rotatably at a relatively rotational lower member to said static member.

6. A police baton with crosshandle as defined in claim 1, wherein the crosshandle comprises:
a static member having a shank protruded from an upper surface thereof and formed by integral molding with the baton main body, and
a relatively rotational upper member which is slidably fit to the shank, in which the hand guard engages at an upper attaching portion to the relatively rotational upper member and is rotatably fit slidably at a lower attaching portion to the static member.

7. A police baton with crosshandle as defined in claim 5 or 6, wherein the hand guard has a generally C-shaped configuration, the upper attaching portion is in a form of an annular ring or a retainer ring which is fit to the relatively rotational upper member of the crosshandle and the lower attaching portion is in a form of an annular ring which is rotatably fit slidably to the static member of the crosshandle.

8. A police baton with crosshandle as defined in any one of claims 1 to 6, wherein the baton main body comprises a rod member having a solid or hollow portion substantially of an identical diameter extending from a position for the crosshandle to a top end.

9. A police baton with crosshandle as defined in any one of claims 1 to 6, wherein the baton main body comprises a rod-like member having a solid or hollow portion which is continuously tapered from a position for the crosshandle to a top end.

10. A police baton with crosshandle as defined in any one of claims 1 to 6, wherein the baton main body has a telescopic rod-like member comprising a plurality of cylindrical members with diameter different from each other, in which said cylindrical members can be contained successively in a telescopic manner, an inner cylindrical member is popped out of an outer cylindrical member by a centrifugal force applied to the baton main body to extend the axial length, and a rear end of an inner cylindrical member is made engageable with a top end of an outer cylinder immediately adjacent therewith.

11. A police baton with crosshandle as defined in any one of claims 1 to 6, wherein a static member of the crosshandle has an elliptic or like other transversal cross sectional shape and a direction of a longer diameter is aligned with the axial direction of the baton main body.

12. A police baton with crosshandle as defined in claims 2, 5 or 6, wherein the upper and lower attaching portions of the hand guard are made detachable engageable with the crosshandle.

* * * * *